US009511894B2

(12) United States Patent
Wilson et al.

(10) Patent No.: US 9,511,894 B2
(45) Date of Patent: Dec. 6, 2016

(54) CARTON WITH OPENING FEATURE

(71) Applicant: Graphic Packaging International, Inc., Atlanta, GA (US)

(72) Inventors: Weston R. Wilson, Arvada, CO (US); Alan Fontaine, Louisville, CO (US); Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 55 days.

(21) Appl. No.: 14/597,616

(22) Filed: Jan. 15, 2015

(65) Prior Publication Data

US 2015/0197383 A1 Jul. 16, 2015

Related U.S. Application Data

(60) Provisional application No. 61/964,915, filed on Jan. 16, 2014.

(51) Int. Cl.

| | |
|---|---|
| ***B65D 5/54*** | (2006.01) |
| ***B31B 1/14*** | (2006.01) |
| ***B31B 1/26*** | (2006.01) |
| *B65D 85/60* | (2006.01) |

(52) U.S. Cl.

CPC ..... *B65D 5/542* (2013.01); *B31B 1/14* (2013.01); *B31B 1/26* (2013.01); *B65D 85/60* (2013.01)

(58) Field of Classification Search

CPC ..... B65D 5/542; B65D 85/60; B65D 5/5425; B65D 5/545; B65D 5/5455; B65D 5/546

USPC ..... 229/223–226, 229, 230, 237, 242

See application file for complete search history.

(56) References Cited

U.S. PATENT DOCUMENTS

| | | | |
|---|---|---|---|
| 1,253,193 | A | 1/1918 | Hill |
| 2,594,376 | A | 4/1952 | Arneson |
| 2,680,558 | A | 6/1954 | Mai |
| 2,810,506 | A | 10/1957 | Kessler |
| 2,868,433 | A | 1/1959 | Anderson, Jr. |
| 2,955,739 | A | 10/1960 | Collura |
| 2,967,010 | A | 1/1961 | Cuffey, Jr. et al. |
| 3,004,697 | A | 10/1961 | Stone |
| 3,036,755 | A | 5/1962 | Stone |

(Continued)

FOREIGN PATENT DOCUMENTS

| | | |
|---|---|---|
| CA | 2160145 | 9/1995 |
| DE | 85 14 718.4 | 6/1985 |

(Continued)

OTHER PUBLICATIONS

International Search Report and Written Opinion for PCT/US2015/011547 dated May 1, 2015.

*Primary Examiner* — Gary Elkins

(74) *Attorney, Agent, or Firm* — Womble Carlyle Sandridge & Rice, LLP

(57) ABSTRACT

A carton having an opening feature. The carton may include a plurality of panels that extends at least partially around an interior of the carton. The plurality of panels may include a top panel, a bottom panel, a first side panel, and a second side panel. The carton may further include a dispenser having a dispenser panel that is at least partially defined by a tear line having a perforation pattern. The perforation pattern may have at least one cut having a central portion, a first distal portion extending from the central portion, and a second distal portion extending from the central portion.

41 Claims, 9 Drawing Sheets

(56) References Cited

U.S. PATENT DOCUMENTS

| | | | | |
|---|---|---|---|---|
| 3,110,434 | A | 11/1963 | Linda et al. | |
| 3,112,856 | A | 12/1963 | MacIntosh et al. | |
| 3,127,720 | A | 4/1964 | Gentry et al. | |
| 3,309,005 | A | 3/1967 | Pilger | |
| 3,310,222 | A | 3/1967 | Buttery | |
| 3,326,364 | A | 6/1967 | Waldrop et al. | |
| 3,410,476 | A | 11/1968 | Buttery | |
| 3,501,082 | A | 3/1970 | Lock | |
| 3,618,848 | A | 11/1971 | Pawlowski et al. | |
| 3,863,834 | A | 2/1975 | Sandford | |
| 3,886,901 | A | 6/1975 | Zeitter | |
| 4,036,423 | A | 7/1977 | Gordon | |
| 4,111,306 | A | 9/1978 | Roccaforte | |
| 4,113,102 | A | 9/1978 | Mueller | |
| 4,216,861 | A | 8/1980 | Oliff | |
| 4,318,474 | A | 3/1982 | Hasegawa | |
| 4,328,923 | A | 5/1982 | Graser | |
| 4,364,509 | A | 12/1982 | Holley et al. | |
| 4,375,258 | A | 3/1983 | Crayne et al. | |
| 4,378,905 | A | 4/1983 | Roccaforte | |
| 4,424,901 | A | 1/1984 | Lanier | |
| 4,498,619 | A | 2/1985 | Roccaforte | |
| 4,511,042 | A | 4/1985 | Wischusen, III | |
| 4,546,914 | A | 10/1985 | Roccaforte | |
| 4,582,199 | A | 4/1986 | Schuster | |
| 4,584,202 | A | 4/1986 | Roccaforte | |
| 4,588,084 | A | 5/1986 | Holley, Jr. | |
| 4,634,007 | A | 1/1987 | Rusnock | |
| 4,676,430 | A * | 6/1987 | Wischusen, III .... | B65D 5/5435 229/121 |
| 4,688,677 | A | 8/1987 | Roccaforte | |
| 4,746,019 | A | 5/1988 | Prater | |
| 4,747,487 | A | 5/1988 | Wood | |
| 5,020,337 | A | 6/1991 | Krieg | |
| 5,094,359 | A | 3/1992 | DeMars et al. | |
| 5,197,598 | A | 3/1993 | Stout et al. | |
| 5,198,276 | A | 3/1993 | Nakajima | |
| 5,246,112 | A | 9/1993 | Stout et al. | |
| 5,284,294 | A | 2/1994 | Floyd | |
| 5,292,058 | A | 3/1994 | Zoss et al. | |
| 5,297,725 | A | 3/1994 | Sutherland | |
| 5,303,863 | A | 4/1994 | Arasim | |
| 5,307,986 | A | 5/1994 | Schuster | |
| 5,333,734 | A | 8/1994 | Stout et al. | |
| 5,427,241 | A | 6/1995 | Sutherland | |
| 5,495,727 | A | 3/1996 | Strong et al. | |
| 5,551,556 | A | 9/1996 | Sutherland | |
| 5,582,343 | A | 12/1996 | Dalvey | |
| 5,593,027 | A | 1/1997 | Sutherland | |
| 5,595,292 | A | 1/1997 | Bates | |
| 5,639,017 | A | 6/1997 | Fogle | |
| 5,699,957 | A | 12/1997 | Blin et al. | |
| 5,704,470 | A | 1/1998 | Sutherland | |
| 5,738,273 | A | 4/1998 | Auclair | |
| 5,794,778 | A | 8/1998 | Harris | |
| 5,826,782 | A | 10/1998 | Stout | |
| 5,873,515 | A | 2/1999 | Dunn et al. | |
| 5,915,546 | A | 6/1999 | Harrelson | |
| 5,992,733 | A | 11/1999 | Gomes | |
| 6,065,590 | A | 5/2000 | Spivey | |
| 6,105,853 | A | 8/2000 | Lamare | |
| 6,105,854 | A | 8/2000 | Spivey et al. | |
| 6,131,803 | A | 10/2000 | Oliff et al. | |
| 6,164,526 | A | 12/2000 | Dalvey | |
| 6,170,741 | B1 | 1/2001 | Skolik et al. | |
| 6,227,367 | B1 | 5/2001 | Harrelson et al. | |
| 6,318,894 | B1 | 11/2001 | Derenthal | |
| 6,523,739 | B2 | 2/2003 | Heeley et al. | |
| 6,631,803 | B2 | 10/2003 | Rhodes et al. | |
| 6,758,337 | B2 | 7/2004 | Chargueraud et al. | |
| 6,926,193 | B2 | 8/2005 | Smalley | |
| 7,427,010 | B2 | 9/2008 | Sutherland | |
| 7,748,603 | B2 | 7/2010 | Fogle et al. | |
| 7,806,314 | B2 | 10/2010 | Sutherland | |
| 8,011,567 | B2 | 9/2011 | DeBusk et al. | |
| 8,191,761 | B2 | 6/2012 | Brand | |
| 8,714,437 | B2 | 5/2014 | Emmott | |
| 2003/0213263 | A1 | 11/2003 | Woog | |
| 2004/0069843 | A1 | 4/2004 | Huffman et al. | |
| 2004/0238611 | A1 | 12/2004 | Sutherland | |
| 2005/0123708 | A1 | 6/2005 | Chen et al. | |
| 2006/0169755 | A1 | 8/2006 | Spivey, Sr. | |
| 2006/0273143 | A1 | 12/2006 | Finch | |
| 2007/0051781 | A1 | 3/2007 | Holley, Jr. | |
| 2007/0164091 | A1 | 7/2007 | Fogle et al. | |
| 2007/0181658 | A1 | 8/2007 | Sutherland | |
| 2007/0284424 | A1 | 12/2007 | Holley | |
| 2008/0073420 | A1 | 3/2008 | Walling et al. | |
| 2010/0044420 | A1 | 2/2010 | Brand | |
| 2010/0108749 | A1 | 5/2010 | House | |
| 2011/0024487 | A1 | 2/2011 | Sant'Ana Caceres et al. | |
| 2012/0189796 | A1 | 7/2012 | Aoyagi et al. | |
| 2013/0186045 | A1 | 7/2013 | Kastanek | |

FOREIGN PATENT DOCUMENTS

| | | |
|---|---|---|
| DE | 20 2004 018 649 | 4/2005 |
| JP | 10-081326 A | 3/1998 |
| JP | 2007 055630 A | 3/2007 |
| JP | 2008-013200 A | 1/2008 |
| JP | 2011-225229 A | 11/2011 |
| WO | WO 2005/080218 | 9/2005 |
| WO | WO 2007/089282 | 8/2007 |

* cited by examiner

CARTON WITH OPENING FEATURE

CROSS-REFERENCE TO RELATED APPLICATIONS

This application claims the benefit of U.S. Provisional Patent Application No. 61/964,915, filed Jan. 16, 2014.

INCORPORATION BY REFERENCE

The disclosure of U.S. Provisional Patent Application No. 61/964,915, which was filed on Jan. 16, 2014, is hereby incorporated by reference for all purposes as if presented herein in its entirety.

BACKGROUND OF THE DISCLOSURE

The present invention generally relates to carriers or cartons for holding and displaying containers. More specifically, the present disclosure relates to a perforation pattern for carton opening features.

SUMMARY OF THE DISCLOSURE

In general, one aspect of the disclosure is directed a carton having an opening feature. The carton may comprise a plurality of panels that extends at least partially around an interior of the carton. The plurality of panels may comprise a top panel, a bottom panel, a first side panel, and a second side panel. The carton may further comprise a dispenser having a dispenser panel that is at least partially defined by a tear line comprising a perforation pattern. The perforation pattern may comprise at least one cut having a central portion, a first distal portion extending from the central portion, and a second distal portion extending from the central portion.

In another aspect, the disclosure is generally directed to a blank for forming a carton having an opening feature. The blank may comprise a plurality of panels for forming an interior of the carton formed from the blank. The plurality of panels may comprise a top panel, a bottom panel, a first side panel, and a second side panel. The blank may further comprise dispenser features for forming a dispenser in the carton formed from the blank. The dispenser features may comprise a dispenser panel that is at least partially defined by a tear line comprising a perforation pattern. The perforation pattern may comprise at least one cut having a central portion, a first distal portion extending from the central portion, and a second distal portion extending from the central portion.

In another aspect, the disclosure is generally directed to a method of forming a carton having an opening feature. The method may comprise obtaining a blank comprising a plurality of panels. The plurality of panels may comprise a top panel, a bottom panel, a first side panel, and a second side panel. The blank further may comprise dispenser features comprising a dispenser panel that is at least partially defined by a tear line comprising a perforation pattern. The perforation pattern may comprise at least one cut having a central portion, a first distal portion extending from the central portion, and a second distal portion extending from the central portion. The method can further comprise forming an interior of the carton at least partially defined by the plurality of panels, and forming a dispenser opening by at least partially removing the dispenser panel from the carton.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENT

The present disclosure relates generally to various aspects of materials, blanks, packages, cartons, constructs, etc., for holding food items, and methods of making such materials, blanks, packages, cartons, and constructs. Although several different disclosures, aspects, implementations, and embodiments are provided, numerous interrelationships between, combinations thereof, and modifications of the various disclosures, aspects, implementations, and embodiments are contemplated hereby. Cartons according to the present disclosure can accommodate packages of numerous different shapes. For the purpose of illustration and not for the purpose of limiting the scope of the disclosure, the following detailed description describes articles (e.g., containers or packages of candy, chocolate or other packaged food item) at least partially disposed within the carton embodiments. In this specification, the terms "lower," "bottom," "upper", "top", "front", and "back," or other terms of orientation, indicate orientations determined in relation to fully erected cartons or packages and any such indication of orientations is not intended to limit the scope of the disclosure as the cartons or packages disclosed herein are capable of different orientations than shown and/or described herein.

Figure 1:
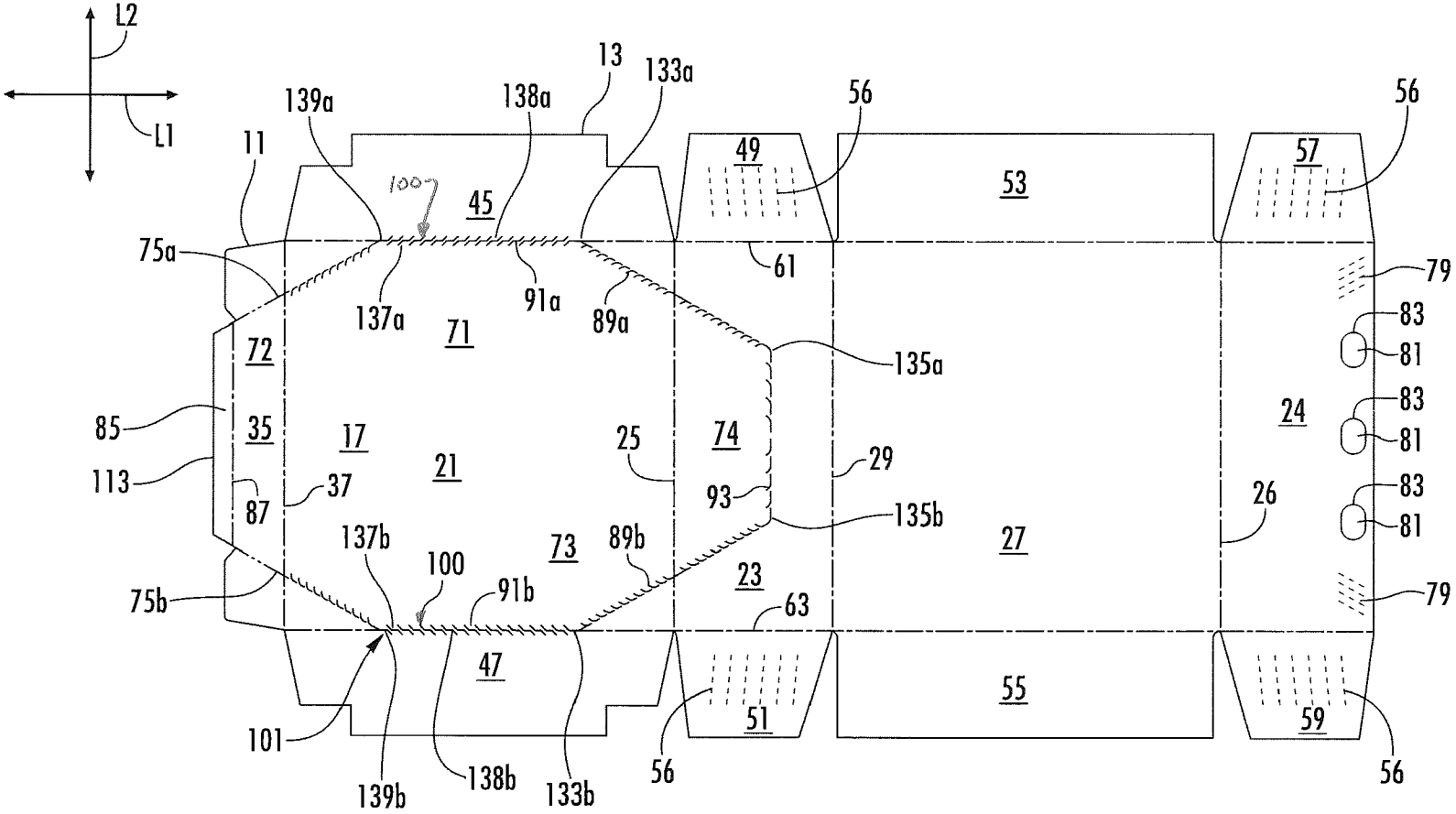
FIG. 1 is a plan view of the exterior surface of a carton blank used to form a carton in accordance with an embodiment of the disclosure.
Figure 2:
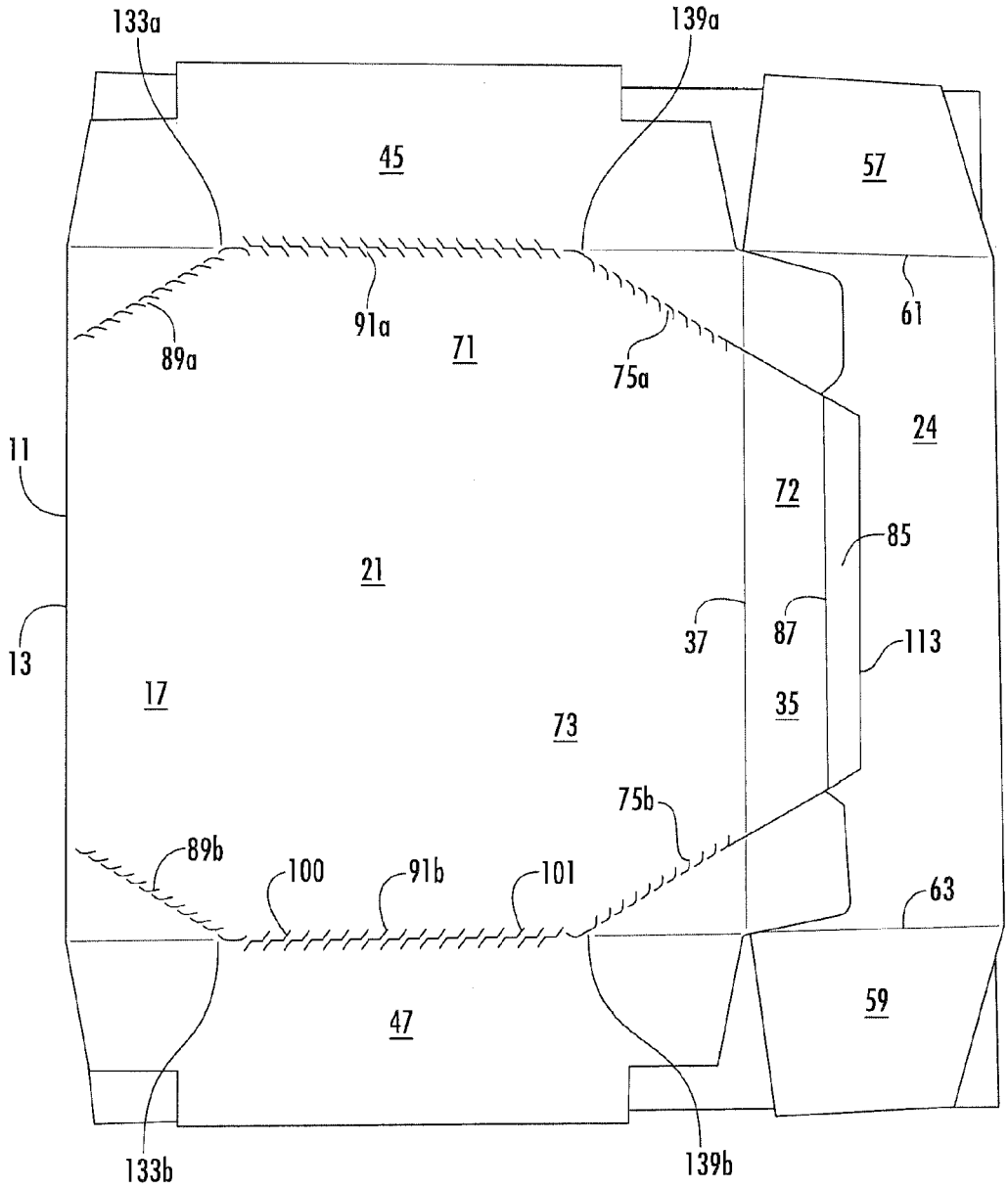
FIG. 2 is a plan view of the blank of FIG. 1 partially folded.

FIG. 1 is a plan view of the exterior side 11 of a blank, generally indicated at 13, used to form a carton 15 (FIGS. 5-6) according to one exemplary embodiment of the disclosure. The carton 15 can be used to house a plurality of containers C. In the illustrated embodiment, the carton 15 is sized to house twenty four containers C in four layers in a 2×3 arrangement, but it is understood that the carton 15 may be sized and shaped to hold containers of a different or same quantity in one or more than one layer and/or in different row/column arrangements (e.g., 3×4, 1×6, 3×6, 2×6×2, 3×3×2, 4×5, 3×5, 2×9, 2×6, 3×4, etc.). In one embodiment, the carton 15 has a dispenser 17 for accessing the containers C in the carton 15. As will be discussed below in more detail, the dispenser 17 can be positioned to an open position (FIGS. 7-8) for accessing the articles (e.g., containers, packages, food items and non-food items) or any other item capable of being contained inside the carton 15.

As illustrated in FIG. 1, the carton blank 13 has a longitudinal axis L1 and a lateral axis L2. In the illustrated embodiment, the blank 13 comprises a top panel 21 foldably connected to a first side panel 23 at a first lateral fold line 25. A bottom panel 27 is foldably connected to the first side panel 23 at a second lateral fold line 29. A second side panel 24 is foldably connected to the bottom panel 27 at a third lateral fold line 26. An attachment panel 35 is foldably connected to the top panel 21 at a fourth lateral fold line 37. In alternative embodiments, the blank 13 can have alternative panel and/or flap arrangements.

Figure 5:
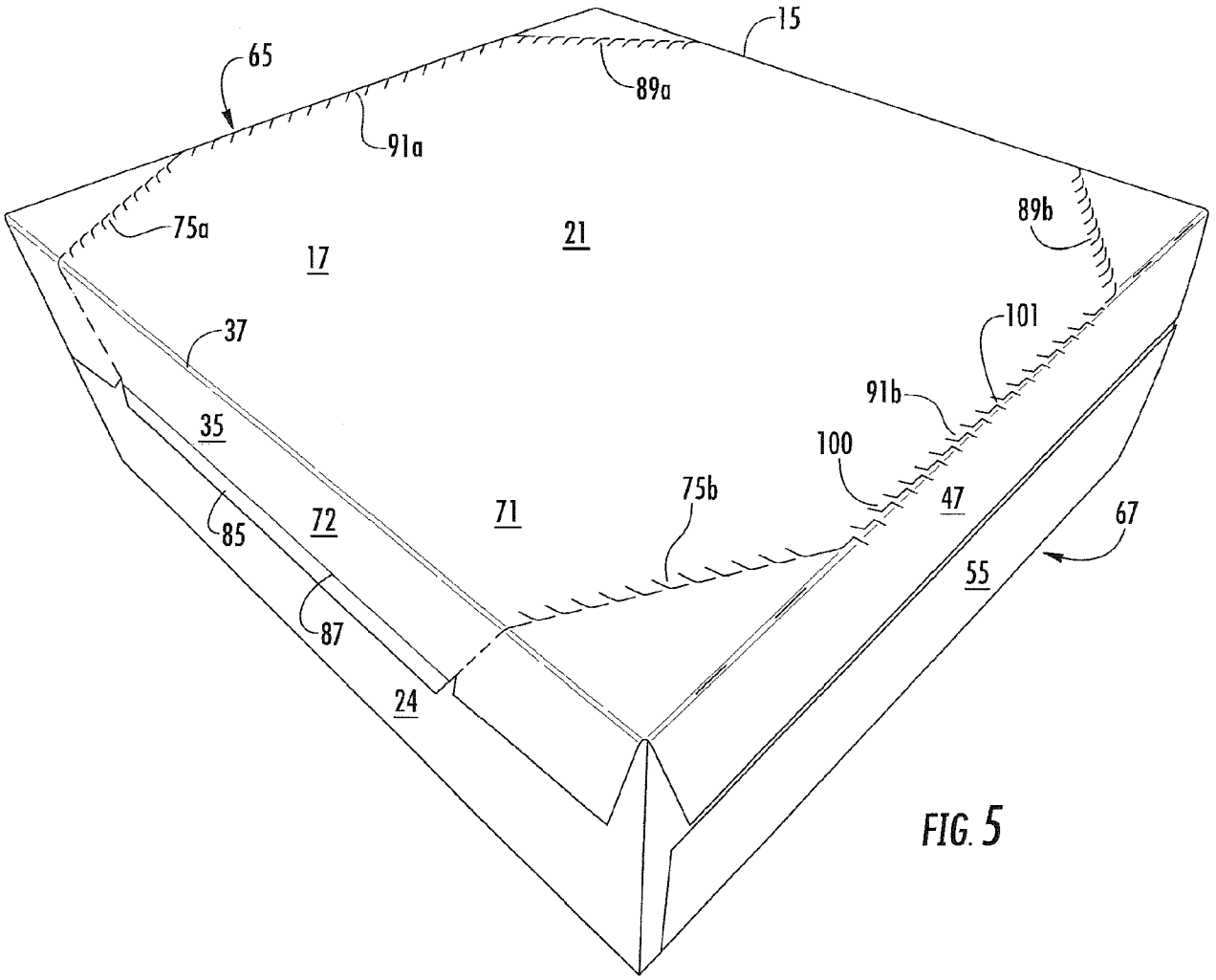
FIG. 5 is a perspective view of a carton according to one embodiment of the disclosure.

In one embodiment, the top panel 21 is foldably connected to a first top end flap 45 and a second top end flap 47. The first side panel 23 is foldably connected to a first side end flap 49 and a second side end flap 51. The bottom panel 27 is foldably connected to a first bottom end flap 53 and a second bottom end flap 55. The second side panel 24 is foldably connected to a first side end flap 57 and a second side end flap 59. When the carton 15 is erected, the top end flap 45, bottom end flap 53, and side end flaps 49, 57 close a first end 65 of the carton 15, and the top end flap 47, bottom end flap 55, and side end flaps 51, 59 close a second end 67 of the carton, as illustrated in FIG. 5. In accordance with an alternative embodiment of the present disclosure, different flap arrangements can be used for at least partially closing the ends 65, 67 of the carton 15.

The top end flap 45, bottom end flap 53, and side end flaps 49, 57 extend along a first marginal area of the blank 13, and are foldably connected at a first longitudinal fold line 61 that extends along the length of the blank 13. The top end flap 47, bottom end flap 55, and side end flaps 51, 59 extend along a second marginal area of the blank 13, and are foldably connected at a second longitudinal fold line 63 that also extends along the length of the blank 13. The longitudinal fold lines 61, 63 may be, for example, substantially straight, or offset at one or more locations to account for blank thickness, varying width of the blank panels, or for other factors.

Figure 8:
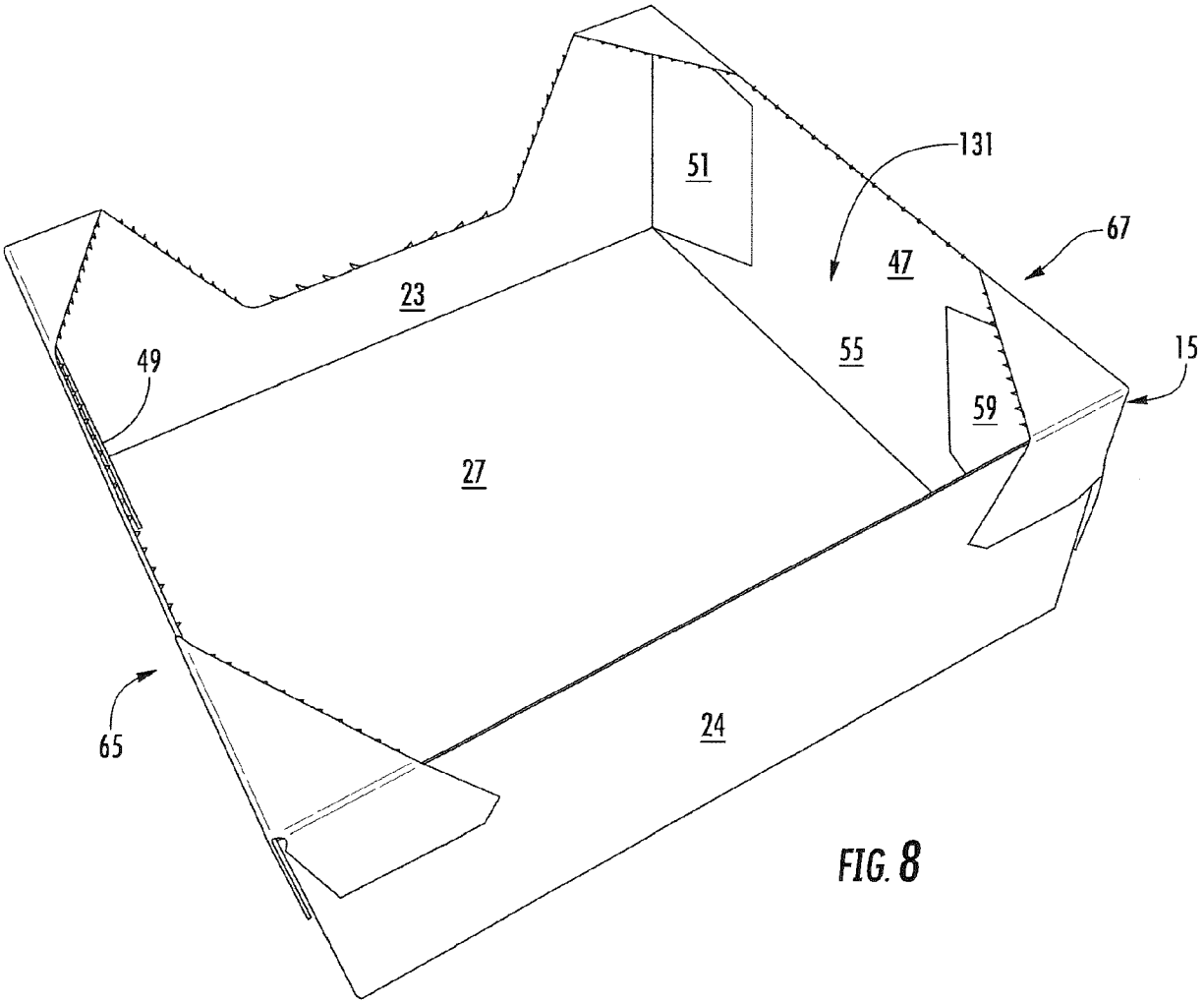
FIG. 8 is a perspective view of the carton in the open configuration.

In one embodiment, the side end flaps 49, 51, 57 and 59 may have several rows of longitudinal partial cuts 56 on the exterior. For illustrative purposes only, FIG. 1 has 6 rows of partial cuts 56, however more or less rows may be used, without departing from the spirit of the disclosure. The partial cuts 56 create a surface that assist with the adhesion of glue when the carton is formed. The side end flaps 49, 51, 57 and 59 and partial cuts 56 can be otherwise shaped, arranged, positioned, and/or omitted without departing from the disclosure. Further the second side panel 24 may comprise adhesive areas 79 and 81 for adhesively connecting the second side panel 24 to the attachment panel 35. The adhesive area 81 may comprise adhesive release areas 83 that circumscribe the adhesive area 81 and are cut for example between 10% to 90% and in one exemplary embodiment 50% through the blank 13. The adhesive release areas 83 can tear and separate from the side panel 24 when the carton 15 is opened into the dispensing position, as illustrated in FIG. 8.

In one embodiment, the dispenser 17 comprises a dispenser panel 71 that is removably attached to the carton at a tear line, generally indicated at 101. The tear line 101 comprises two oblique portions 75*a*, 75*b* that are spaced apart and extend from the edge 113 of the blank to a respective edge of the longitudinal portion 91*a*, 91*b* of the tear line 101. As illustrated in FIG. 1, the longitudinal portions 91*a*, 91*b* are collinear with at least a portion of respective longitudinal fold lines 61, 63. In one embodiment, the tear line 101 comprises two oblique portions 89*a*, 89*b* extending from respective edges 133*a*, 133*b* of respective longitudinal portions 91*a*, 91*b* to edges 135*a*, 135*b* of lateral portion 93 of the tear line 101. In the illustrated embodiment, the oblique portions 75*a*, 75*b* extend across the attachment panel 35 and a portion of the top panel 21 to respective edges 139*a*, 139*b* of longitudinal portions 91*a*, 91*b*. Further, the longitudinal portions 91*a*, 91*b* are collinear with a portion of the longitudinal fold lines 61, 63 that extends along or between a first longitudinal edge 137*a* of the top panel 21 and a third longitudinal edge 138*a* of the first top end flap 45, and a second longitudinal edge 137*b* of the top panel 21 and a fourth longitudinal edge 138*b* of the second top end flap 47, respectively. The oblique portions 89*a*, 89*b* of the tear line 101 extend from the longitudinal portions 91*a*, 91*b* across a portion of the top panel 21 and into a portion of the first side panel 23 to the lateral portion 93 of the tear line. The tear line 101 could be otherwise shaped, arranged, and/or configured without departing from the disclosure. For instance, the tear line 21 could be curved without departing from the disclosure.

In the illustrated embodiment, the dispenser panel 71 has a first portion 72, a second portion 73, and a third portion 74. The first portion 72 is in the attachment panel 35 and defined by the edge 113 of the blank 13, the oblique portions 75*a*, 75*b* of the tear line 101, and the lateral fold line 37. In one embodiment, the first portion 72 comprises an access flap 85 foldably connected to the attachment panel 35 at a lateral fold line 87. The access flap 85 comprises a portion of the attachment panel 35 that does not include glue and therefore can be lifted and/or pulled to open the carton. The second portion 73 is in the top panel 21 and is at least partially defined by lateral fold lines 25, 37, the oblique portions 75*a*, 75*b* of the tear line 101 in the top panel, the longitudinal tear lines 91*a*, 91*b*, and the oblique portion 89*a*, 89*b* of the tear line portion in the top panel. The third portion 74 is in the first side panel 23 and is at least partially defined by the portions of the oblique tear lines 89 in the first side panel and the lateral tear line 93. The dispenser panel 71, including one or more of the first portion 72, the second portion 73, and the third portion 74, could be otherwise shaped, arranged, configured without departing from the disclosure.

Figure 9:
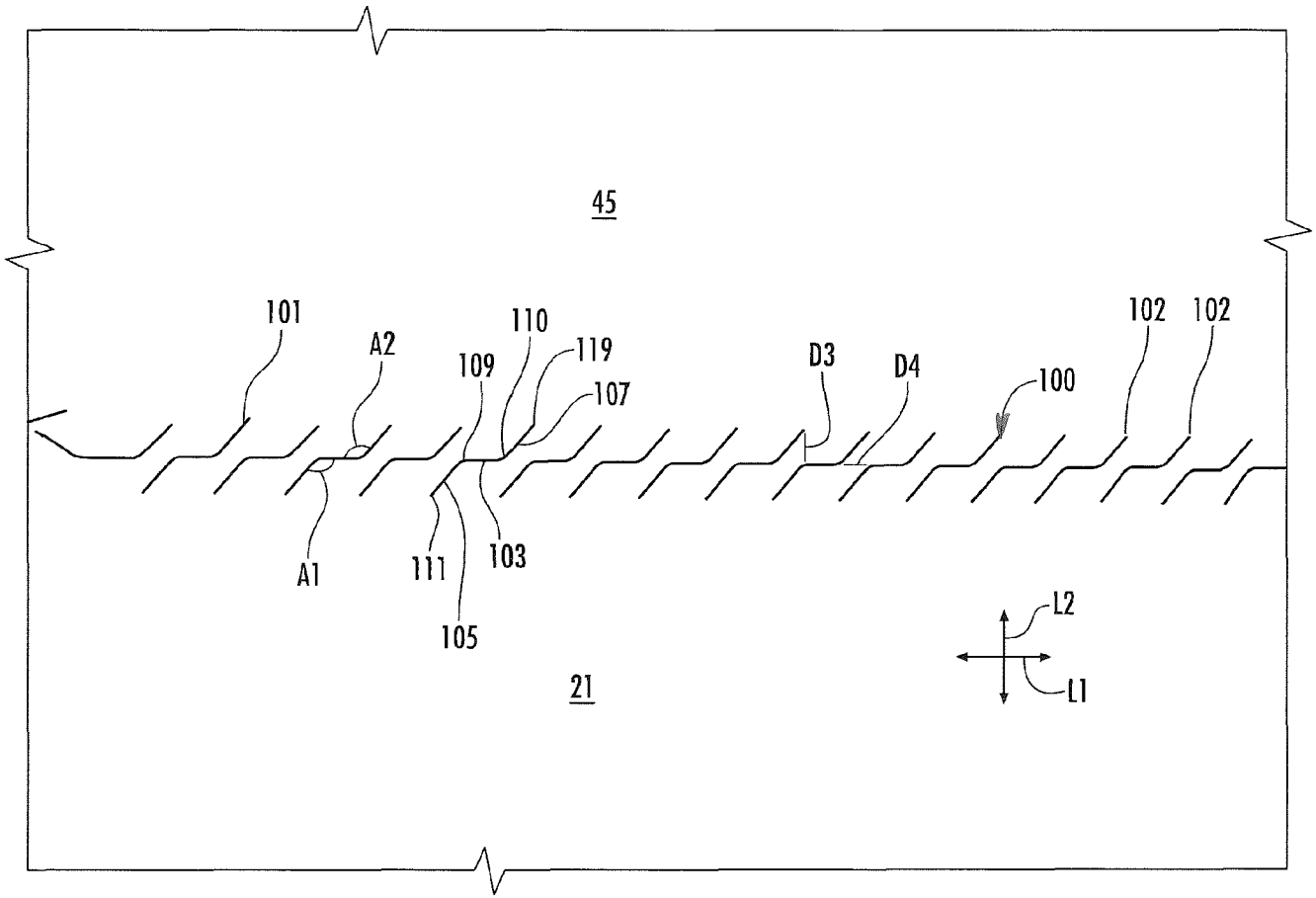
FIG. 9 is an enlarged plan view of a portion of a perforation pattern.

In one embodiment, one or more of the portions 75*a*, 89*a*, 91*a*, 93, 75*b*, 89*b*, 91*b*, and 93*b* of the tear line 101 can comprise a Z-shaped perforation pattern 100. As shown in FIGS. 1 and 9, the longitudinal portions 91*a*, 91*b* of the tear line 101 comprise the perforation patterns 100. As shown in FIG. 9, the perforation pattern 100 comprises a series of spaced apart cuts 102. Each of the cuts 102 are similar in shape and therefore only one of the cuts will be described in detail but it is understood that the other cuts of the perforation pattern 100 will have similar features. Each cut 102 has a central portion 103 extending in the longitudinal direction of fold lines 61, 63 and having a first end 109 and a second end 110. A first distal portion 105 of the cut 102 extends from the first end 109 at an obtuse angle A1 (FIG. 9) relative to the central portion to a terminal end 111 of the cut. A second distal portion 107 of the cut extends from the second end 110 of the central portion 103 at an obtuse angle A2 (FIG. 9) relative to the central portion to a terminal end 119 of the cut. In one embodiment, the angles A1 and A2 can be approximately equal so that the first distal portion 105 and the second distal portion 107 are generally parallel. The central portion 103, first distal portion 105, and the second distal portion 107 may have a length between 1 mm and 10 cm and more preferably between 3 mm and 10 mm. The angles A1, A2 may range, for example from 0 to 180 degrees or between 120 and 150 degrees.

In one embodiment, adjacent cuts 102 may be spaced apart a distance D3 in the lateral direction L2 and may be spaced apart a distance D4 in the longitudinal direction L1. The distances D3 and D4 may range, for example from at least 0.1 mm-10 mm or at least between 1-4 mm. The dimension noted herein are exemplary only and are not intended to limit the scope of the disclosure as the distances or features shown herein could be otherwise dimensioned, shaped, arranged, and/or configured without departing from the disclosure.

In one embodiment the central portion 103 of each cut 102 may be centered along a respective fold line 61, 63 so that the central portion 103 is collinear with a respective fold line and the distal portions 105, 107 are oblique relative to the central portion and the fold line. In one embodiment, the first distal portion 105 may extend into the top panel 21 and the second distal portion 107 may extend into a respective end flap 45, 47. However, the Z-shaped perforation pattern 100 is not limited to be along corner edges of respective panels. For example, the pattern 100 may be positioned to be out of alignment with fold lines 61, 63 and can further be used to form other removable features. In another example, the Z-shaped perforation pattern 100 may also be used to form any of the tear lines 75*a*, 89*a*, 93, 75*b*, 89*b* or could be used to form other removable features in the blank 13 and/or carton 15.

Figure 3:
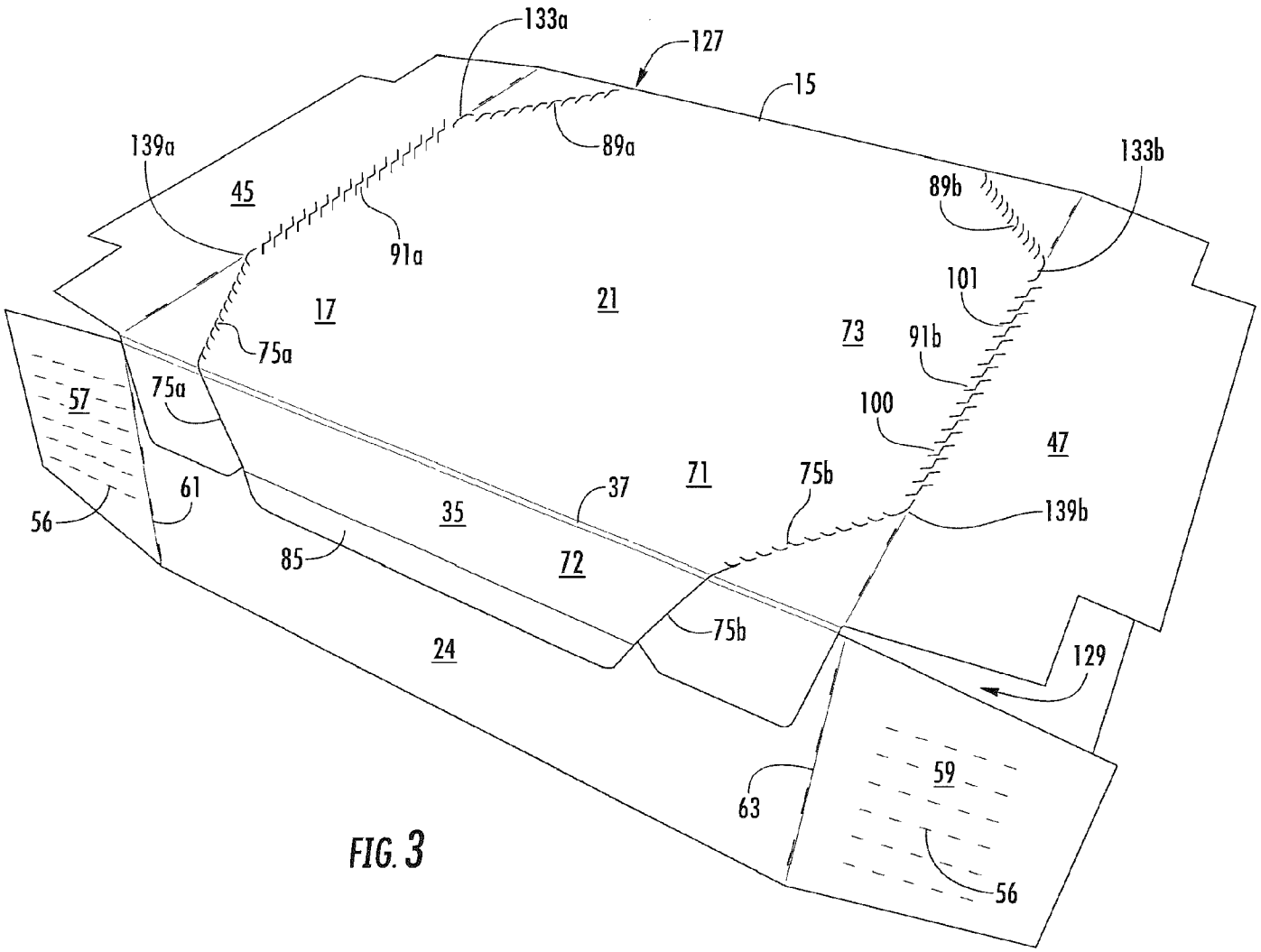
FIG. 3 is a perspective view of a partially formed carton
Figure 4:
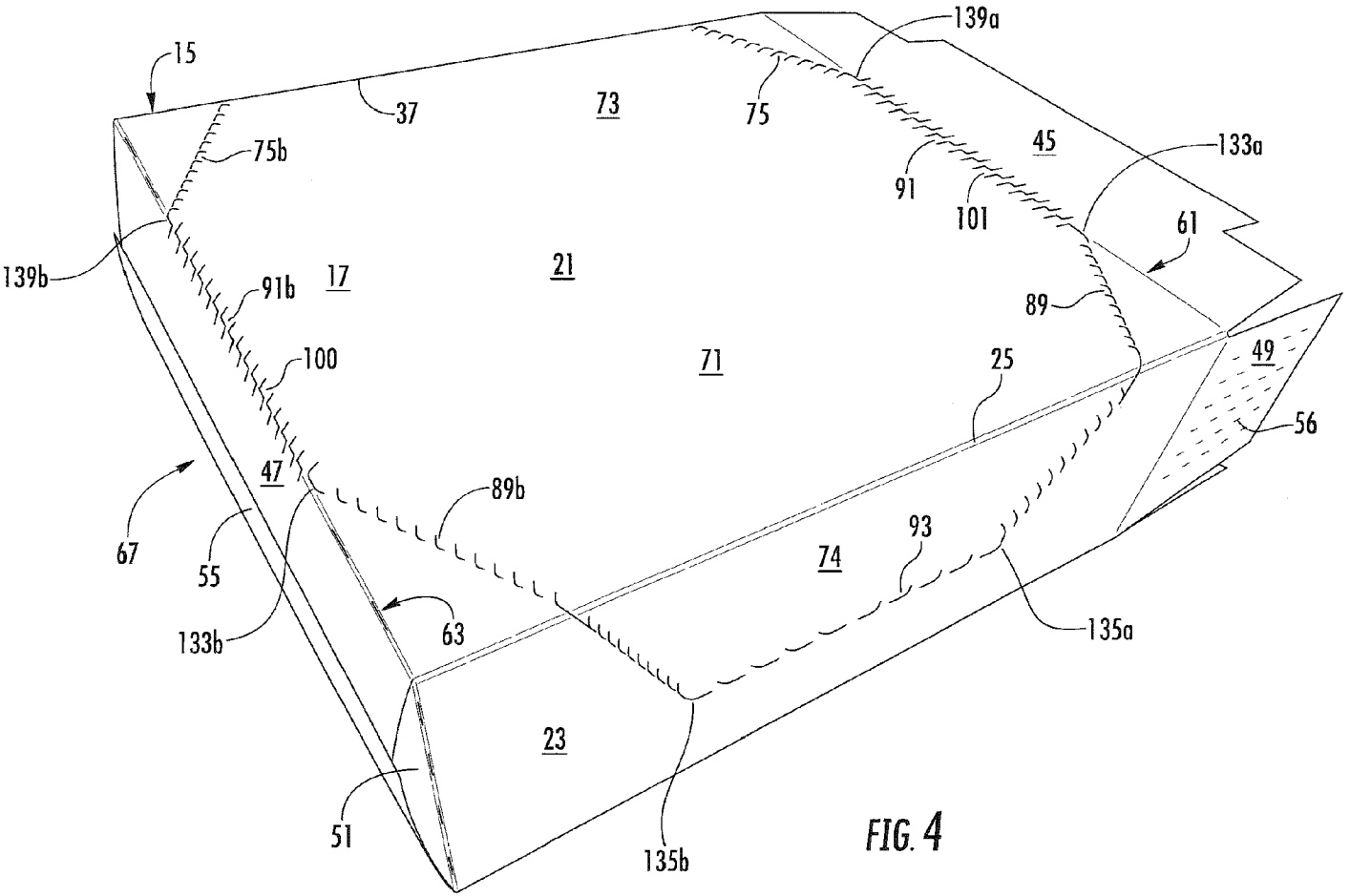
FIG. 4 is a perspective view of a partially formed carton.
Figure 6:
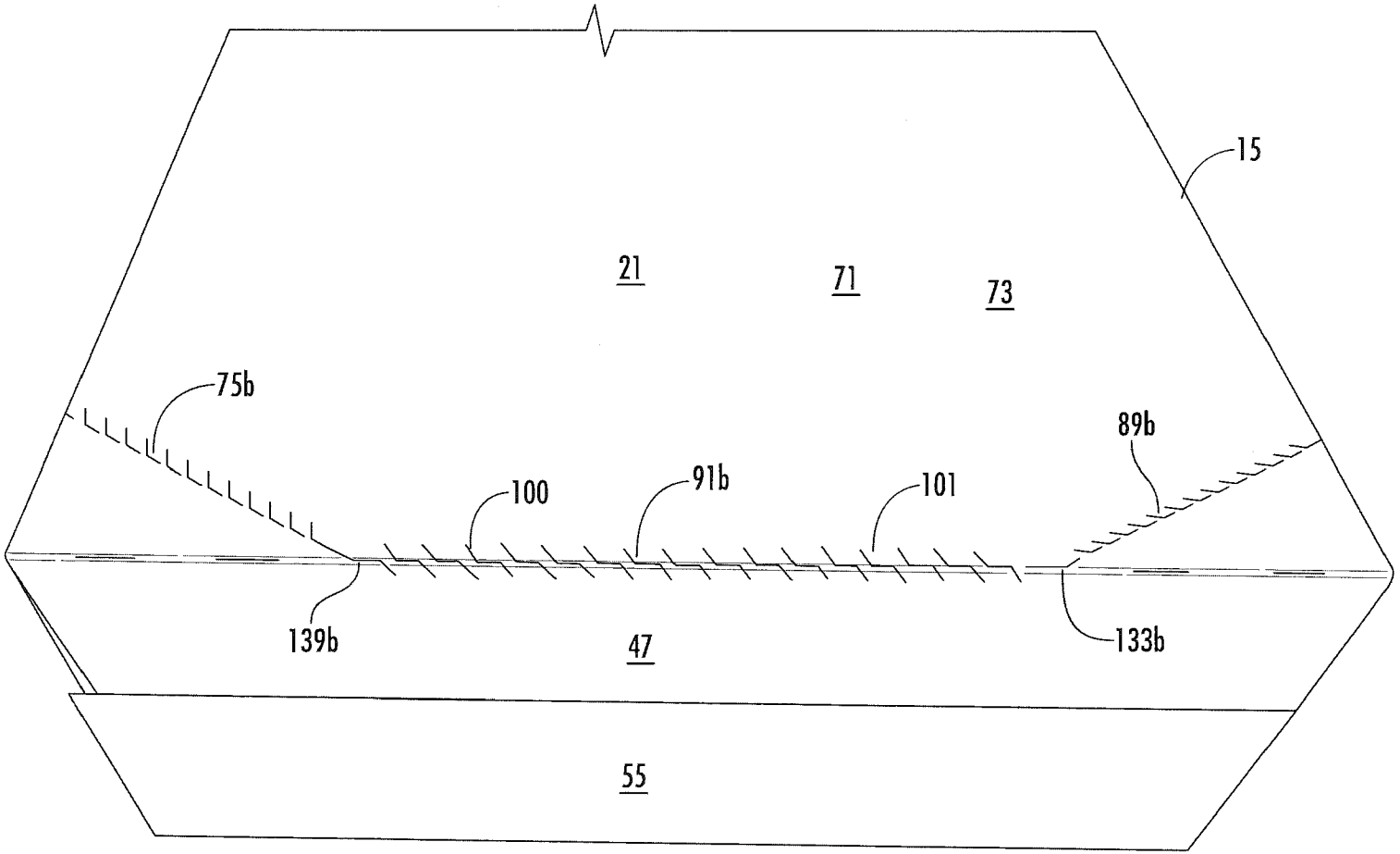
FIG. 6 is a side perspective view of the carton of FIG. 5.

In one exemplary embodiment shown in FIGS. 2-6, the carton 15 can be assembled from the blank 13 by initially folding the second side panel 24 along fold line 26 (FIG. 2) and then folding the first top panel 21 along fold line 25 so that the attachment panel 35 overlaps the second side panel 24. The attachment panel 35 can be secured in face-to-face contact by adhesive applied either to the interior surface of the attachment panel 35 or the adhesive areas on the exterior surface of the second side panel 24. As shown in FIG. 3 the side panels 23, 24 can then be positioned relative to the top panel 21 and the bottom panel 27 to form a generally open-ended tubular sleeve 127 and at least partially forming the interior space 129. The tubular sleeve 127 can be filled with articles/containers (not shown) prior to closing the ends 65, 67 of the carton 15, or one of the ends can be closed prior to loading the containers. Once the containers are loaded, the ends 65, 67 of the sleeve 127 can be closed to form the closed carton 15, as illustrated by FIGS. 4-6, by at least partially overlapping the end flaps 45, 49, 53, 57 to close the first end 65, and at least partially overlapping the end flaps 47, 51, 55, 59 to close the second end 67. The carton 15 can be assembled and loaded by other positioning steps without departing from the disclosure.

Figure 7:
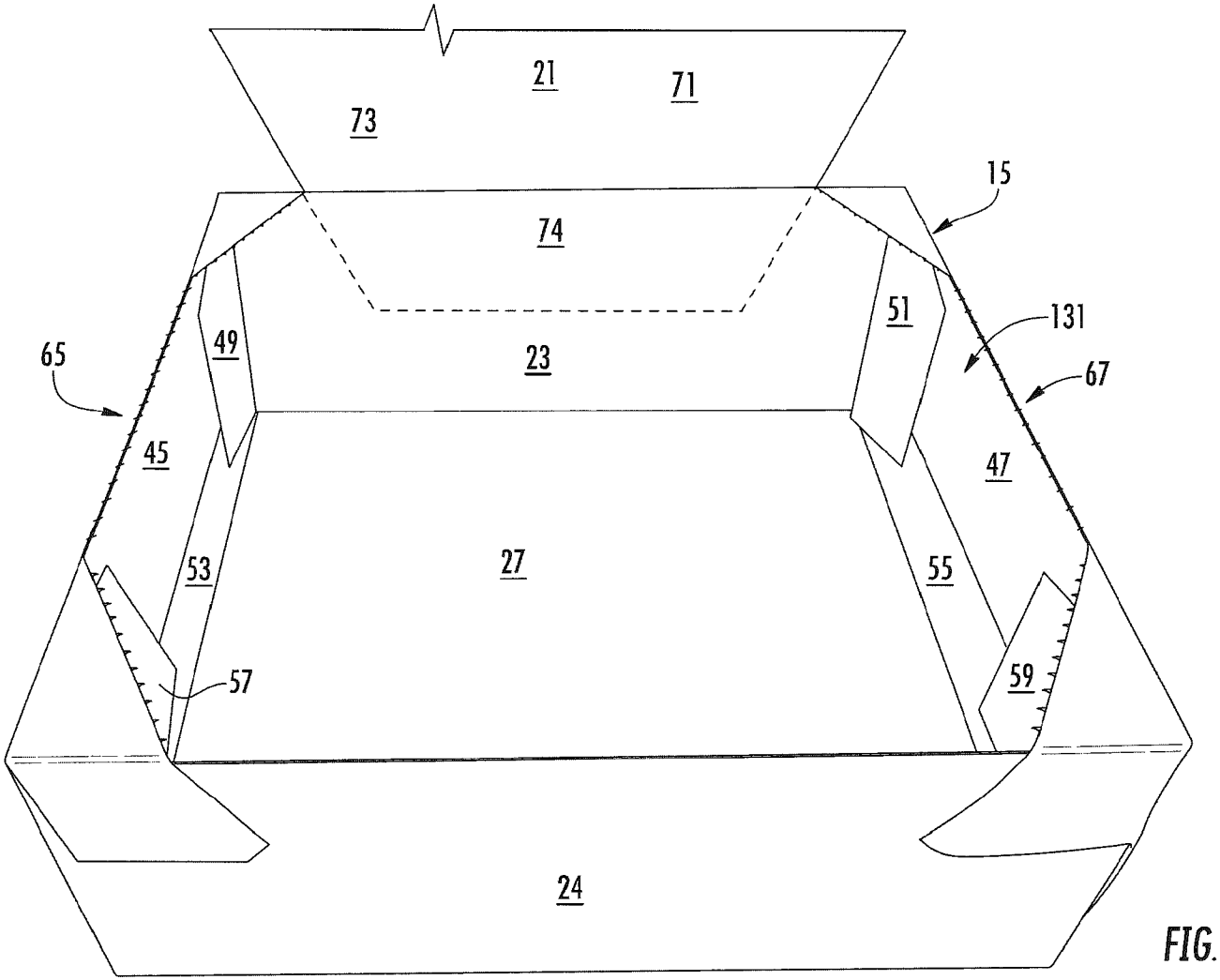
FIG. 7 is a perspective view of the carton of FIG. 5 partially open.

As shown in FIGS. 7-8, the dispenser 17 can be opened by grasping the access flap portion 85 and tearing the dispenser panel 71 along respective portions 75*a*, 91*a*, 89*a*, 93, and 75*b*, 91*b*, 89*b* of the tear line 101 to form a dispenser opening 131. In one embodiment, containers can be removed from the dispenser opening 131 by a consumer. Alternatively, the dispenser 17 may comprise one or more dispenser and dispenser openings or the dispenser could be otherwise configured to have one or more openings of other shapes and sizes. Further, the dispenser 17 could alternatively include one or more dispenser panels in the first side panel 23 to allow the user to remove containers through dispenser opening(s) in the other side panel without departing from the disclosure. Also, the dispenser 17 could comprise one or more dispenser panels that comprise at least a portion of the bottom panel 27 without departing from the disclosure. Further, the dispenser 17 could be omitted without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton having an opening feature, the carton comprising:

a plurality of panels that extends at least partially around an interior of the carton the plurality of panels comprises a top panel, a bottom panel, a first side panel, and a second side panel;

a dispenser having a dispenser panel that is at least partially defined by a tear line comprising a perforation pattern, the perforation pattern extends in a longitudinal direction and comprises a plurality of cuts comprising a first cut, a second cut, and a third cut, the second cut being adjacent the first cut and the third cut, the first cut comprising a first central portion extending in the longitudinal direction and having a first end and a second end, a first distal portion extending from the first end of the first central portion, and a second distal portion extending from the second end of the first central portion, the first distal portion being oblique relative to the longitudinal direction and comprising a first terminal end of the first cut, the second distal portion being oblique relative to the longitudinal direction and comprising a second terminal end of the first cut, the second cut comprising a second central portion extending in the longitudinal direction and having a first end and a second end, a third distal portion extending from the first end of the second central portion, and a fourth distal portion extending from the second end of the second central portion, the third distal portion being oblique relative to the longitudinal direction and comprising a first terminal end of the second cut, the fourth distal portion being oblique relative to the longitudinal direction and comprising a second terminal end of the second cut, and the third cut comprising a third central portion extending in the longitudinal direction and having a first end and second end, a fifth distal portion extending from the first end of the third central portion, and a sixth distal portion extending from the second end of the third central portion, the fifth distal portion being oblique relative to the longitudinal direction and comprising a first terminal end of the third cut, the sixth distal portion being oblique relative to the longitudinal direction and comprising a second terminal end of the third cut, the second terminal end of the first cut is spaced apart from the first end of the second central portion of the second cut by a first distance extending in a lateral direction perpendicular to the longitudinal direction and the second terminal end of the second cut is spaced apart from the first end of the third central portion of the third cut by a second distance extending in the lateral direction, the first distance and the second distance being equal.

2. The carton of claim 1, wherein the top panel is foldably connected to an at least one end flap at a fold line, the tear line is collinear with the fold line and the first central portion is generally parallel to the fold line.

3. The carton of claim 2, wherein the fold line extends in a longitudinal direction.

4. The carton of claim 2, wherein the first distal portion extends at a first angle relative to the first central portion.

5. The carton of claim 4, wherein the first distal portion is oblique relative to the first central portion.

6. The carton of claim 4, wherein the second distal portion extends at a second angle relative to the first central portion.

7. The carton of claim 6, wherein the first angle and the second angle are equal.

8. The carton of claim 7, wherein the first angle and the second angle are greater than 90 degrees.

9. The carton of claim 6, wherein the first distal portion and the second distal portion are oblique relative to the first central portion.

10. The carton of claim 6, wherein the first angle and the second angle are between approximately 120 degrees and approximately 150 degrees.

11. The carton of claim 2, wherein the perforation pattern comprises at least four spaced-apart cuts.

12. The carton of claim 2, wherein the first central portion is generally collinear with the fold line, the first distal portion extends into the at least one end flap, and the second distal portion extends into the top panel.

13. The carton of claim 1, wherein the first central portion, the second central portion, and the third central portion are parallel and collinear.

14. The carton of claim 1, wherein the first distal portion, the second distal portion, the third distal portion, the fourth distal portion, the fifth distal portion, and the sixth distal portion are parallel.

15. The carton of claim 1, wherein the second end of the first central portion is spaced apart from the first end of the second central portion by a third distance extending in the longitudinal direction, the second end of the second central portion is spaced apart from the first end of the third central portion by a fourth distance extending in the longitudinal direction, the third distance and the fourth distance being equal.

16. The blank of claim 1, wherein the second end of the first central portion is spaced apart from the first end of the second central portion by a third distance extending in the longitudinal direction, the second end of the second central portion is spaced apart from the first end of the third central portion by a fourth distance extending in the longitudinal direction, the third distance and the fourth distance being equal.

17. A blank for forming a carton having an opening feature, the blank comprising:

a plurality of panels for forming an interior of the carton formed from the blank, the plurality of panels comprises a top panel, a bottom panel, a first side panel, and a second side panel; and dispenser features for forming a dispenser in the carton formed from the blank, the dispenser features comprise a dispenser panel that is at least partially defined by a tear line comprising a perforation pattern, the perforation pattern extends in a longitudinal direction and comprises a plurality of cuts comprising a first cut, a second cut, and a third cut, the second cut being adjacent the first cut and the third cut, the first cut comprising a first central portion extending in the longitudinal direction and having a first end and a second end, a first distal portion extending from the first end of the first central portion, and a second distal portion extending from the second end of the first central portion, the first distal portion being oblique relative to the longitudinal direction and comprising a first terminal end of the first cut, the second distal portion being oblique relative to the longitudinal direction and comprising a second terminal end of the first cut, the second cut comprising a second central portion extending in the longitudinal direction and having a first end and a second end, a third distal portion extending from the first end of the second central portion, and a fourth distal portion extending from the second end of the second central portion, the third distal portion being oblique relative to the longitudinal direction and comprising a first terminal end of the second cut, the fourth distal portion being oblique relative to the longitudinal direction and comprising a second terminal end of the second cut, and the third cut comprising a third central portion extending in the longitudinal direction and having a first end and second end, a fifth distal portion extending from the first end of the third central portion, and a sixth distal portion extending from the second end of the third central portion, the fifth distal portion being oblique relative to the longitudinal direction and comprising a first terminal end of the third cut, the sixth distal portion being oblique relative to the longitudinal direction and comprising a second terminal end of the third cut, the second terminal end of the first cut is spaced apart from the first end of the second central portion of the second cut by a first distance extending in a lateral direction perpendicular to the longitudinal direction and the second terminal end of the second cut is spaced apart from the first end of the third central portion of the third cut by a second distance extending in the lateral direction, the first distance and the second distance being equal.

18. The blank of claim 17, wherein the top panel is foldably connected to an at least one end flap at a fold line, the tear line is collinear with the fold line, and the first central portion is generally parallel to the fold line.

19. The blank of claim 18, wherein the fold line extends in a longitudinal direction.

20. The blank of claim 18, wherein the first distal portion extends at a first angle relative to the first central portion.

21. The blank of claim 20, wherein the first distal portion is oblique relative to the first central portion.

22. The blank of claim 20, wherein the second distal portion extends at a second angle relative to the first central portion.

23. The blank of claim 22, wherein the first angle and the second angle are equal.

24. The blank of claim 23, wherein the first angle and the second angle are greater than 90 degrees.

25. The blank of claim 22, wherein the first distal portion and the second distal portion are oblique relative to the first central portion.

26. The blank of claim 22, wherein the first angle and the second angle are between approximately 120 degrees and approximately 150 degrees.

27. The blank of claim 18, wherein the perforation pattern comprises at least four spaced-apart cuts.

28. The blank of claim 18, wherein the first central portion is generally collinear with the fold line, the first distal portion extends into the at least one end flap, and the second distal portion extends into the top panel.

29. The blank of claim 17, wherein the first central portion, the second central portion, and the third central portion are collinear.

30. The blank of claim 17, wherein the first distal portion, the second distal portion, the third distal portion, the fourth distal portion, the fifth distal portion, and the sixth distal portion are parallel.

31. A method of forming a carton having an opening feature, the method comprising:

obtaining a blank comprising a plurality of panels, the plurality of panels comprising a top panel, a bottom panel, a first side panel, and a second side panel, and dispenser features comprising a dispenser panel that is at least partially defined by a tear line comprising a perforation pattern, the perforation pattern extends in a longitudinal direction and comprises a plurality of cuts comprising a first cut, a second cut, and a third cut, the second cut being adjacent the first cut and the third cut, the first cut comprising a first central portion extending in the longitudinal direction and having a first end and a second end, a first distal portion extending from the first end of the first central portion, and a second distal portion extending from the second end of the first central portion, the first distal portion being oblique relative to the longitudinal direction and comprising a first terminal end of the first cut, the second distal portion being oblique relative to the longitudinal direction and comprising a second terminal end of the first cut, the second cut comprising a second central portion extending in the longitudinal direction and having a first end and a second end, a third distal portion extending from the first end of the second central portion, and a fourth distal portion extending from the second end of the second central portion, the third distal portion being oblique relative to the longitudinal direction and comprising a first terminal end of the second cut, the fourth distal portion being oblique relative to the longitudinal direction and comprising a second terminal end of the second cut, and the third cut comprising a third central portion extending in the longitudinal direction and having a first end and second end, a fifth distal portion extending from the first end of the third central portion, and a sixth distal portion extending from the second end of the third central portion, the fifth distal portion being oblique relative to the longitudinal direction and comprising a first terminal end of the third cut, the sixth distal portion being oblique relative to the longitudinal direction and comprising a second terminal end of the third cut, the second terminal end of the first cut is spaced apart from the first end of the second central portion of the second cut by a first distance extending in a lateral direction perpendicular to the longitudinal direction and the second terminal end of the second cut is spaced apart from the first end of the third central portion of the third cut by a second distance extending in the lateral direction, the first distance and the second distance being equal;

forming an interior of the carton at least partially defined by the plurality of panels; and forming a dispenser opening by tearing along the tear line and at least partially removing the dispenser panel from the carton.

32. The method of claim 31, wherein the top panel is foldably connected to one of the first side panel and the second side panel at a fold line, the tear line is collinear with the fold line and the first central portion is generally parallel to the fold line.

33. The method of claim 32, wherein the first distal portion extends at a first angle relative to the first central portion.

34. The method of claim 33, wherein the first distal portion is oblique relative to the first central portion.

35. The method of claim 33, wherein the second distal portion extends at a second angle relative to the first central portion.

36. The method of claim 35, wherein the first angle and the second angle are equal.

37. The method of claim 36, wherein the first angle and the second angle are greater than 90 degrees.

38. The method of claim 35, wherein the first distal portion and the second distal portion are oblique relative to the first central portion.

39. The method of claim 35, wherein the first angle and the second angle are between approximately 120 degrees and approximately 150 degrees.

40. The method of claim 32, wherein the perforation pattern comprises at least four spaced-apart cuts.

41. The method of claim 32, wherein the first side panel is formed by a least one end flap foldably connected to the top panel along the fold line, the first central portion is generally collinear with the fold line, the first distal portion extends into the at least one end flap, and the second distal portion extends into the top panel.

* * * * *